US005116520A

United States Patent [19]

Lichtenwalter et al.

[11] Patent Number: 5,116,520

[45] Date of Patent: May 26, 1992

[54] FABRIC SOFTENING AND ANTI-STATIC COMPOSITIONS CONTAINING A QUATERNIZED DI-SUBSTITUTED IMIDAZOLINE ESTER FABRIC SOFTENING COMPOUND WITH A NONIONIC FABRIC SOFTENING COMPOUND

[75] Inventors: Glen D. Lichtenwalter, Corsicana, Tex.; Theresa Rosario-Jansen, Fairfield; Errol H. Wahl, Cincinnati, both of Ohio

[73] Assignee: The Procter & Gamble Co., Cincinnati, Ohio

[21] Appl. No.: 542,843

[22] Filed: Jun. 25, 1990

Related U.S. Application Data

[63] Continuation-in-part of Ser. No. 403,549, Sep. 6, 1989, abandoned.

[51] Int. Cl.[5] ..... D06M 10/08

[52] U.S. Cl. ..... 252/8.6; 252/8.7; 252/8.75; 252/8.8; 252/8.9

[58] Field of Search ..... 252/8.7, 8.75, 8.8, 252/8.9

[56] References Cited

U.S. PATENT DOCUMENTS

| | | | |
|---|---|---|---|
| 2,874,074 | 2/1959 | Johnson | 117/139.5 |
| 2,995,520 | 8/1961 | Luvisi | 252/8.8 |
| 3,095,373 | 6/1963 | Blomfield | 252/8.8 |
| 3,537,993 | 11/1970 | Coward et al. | 252/8.75 |
| 3,689,424 | 9/1972 | Berg et al. | 252/110 |
| 4,076,632 | 2/1978 | Davis | 252/8.8 |
| 4,126,562 | 11/1978 | Goffinet et al. | 252/8.8 |
| 4,127,489 | 11/1978 | Pracht et al. | 252/8.8 |
| 4,128,484 | 12/1978 | Barford et al. | 252/8.8 |
| 4,140,641 | 2/1979 | Ramachandran | 252/8.75 |
| 4,141,841 | 2/1979 | McDonald | 252/8.8 |
| 4,157,307 | 6/1979 | Jaeger et al. | 252/8.75 |
| 4,162,984 | 7/1979 | DeBlock et al. | 252/8.8 |
| 4,166,794 | 9/1979 | Grey | 252/8.8 |
| 4,179,382 | 12/1979 | Rudkin et al. | 252/8.8 |
| 4,233,451 | 11/1980 | Pracht et al. | 548/354 |
| 4,237,016 | 12/1980 | Rudkin et al. | 252/8.8 |
| 4,360,437 | 11/1982 | Wolfes | 252/8.8 |
| 4,401,578 | 8/1983 | Verbruggen | 252/8.8 |
| 4,426,299 | 1/1984 | Verbruggen | 252/8.8 |
| 4,429,859 | 2/1984 | Steiner et al. | 252/8.8 |
| 4,439,330 | 3/1984 | Ooms | 252/8.8 |
| 4,454,049 | 6/1984 | MacGilp et al. | 252/8.8 |
| 4,476,031 | 10/1984 | Ooms | 252/8.8 |
| 4,497,716 | 2/1985 | Tai | 252/8.8 |
| 4,661,267 | 4/1987 | Dekker et al. | 252/8.8 |
| 4,661,269 | 4/1987 | Trinh et al. | 252/8.8 |
| 4,661,289 | 4/1987 | Parslow et al. | 252/547 |
| 4,724,089 | 2/1988 | Konig et al. | 252/8.8 |
| 4,767,547 | 8/1988 | Straathof et al. | 252/8.8 |
| 4,770,815 | 9/1988 | Baker et al. | 252/542 |
| 4,789,491 | 12/1988 | Chang et al. | 252/8.75 |
| 4,806,255 | 2/1989 | Konig et al. | 252/8.8 |
| 4,840,738 | 6/1989 | Hardy et al. | 252/8.6 |
| 4,844,823 | 7/1989 | Jacques et al. | 252/8.8 |
| 4,956,447 | 9/1990 | Gosselink et al. | 252/526 |

FOREIGN PATENT DOCUMENTS

| | | |
|---|---|---|
| 1102511 | 6/1981 | Canada . |
| 0000406 | 1/1979 | European Pat. Off. . |
| 0018039 | 10/1980 | European Pat. Off. . |
| 0122140 | 10/1984 | European Pat. Off. . |
| 0159918 | 11/1985 | European Pat. Off. . |
| 0159920 | 11/1985 | European Pat. Off. . |
| 0309052 | 3/1989 | European Pat. Off. . |
| 0345842 | 12/1989 | European Pat. Off. . |
| 2243806 | 4/1974 | Fed. Rep. of Germany . |
| 52-132194 | 11/1977 | Japan . |
| 58-144175 | 8/1983 | Japan . |
| 61-207669A | 9/1986 | Japan . |
| 61-207670A | 9/1986 | Japan . |
| 1565808 | 4/1980 | United Kingdom . |
| 1601360 | 10/1981 | United Kingdom . |

*Primary Examiner*—A. Lionel Clingman
*Assistant Examiner*—William S. Parks
*Attorney, Agent, or Firm*—Leonard W. Lewis; Katherine Lynn Stewart; R. C. Witte

[57] ABSTRACT

Disclosed are textile treatment compositions comprising a quaternized di-substituted imidazoline ester fabric softening compound, a nonionic fabric softening compound, and a liquid carrier. The textile treatment compositions of the present invention possess desirable storage-stability, viscosity, and fabric-conditioning properties. The compositions may be in the form of aqueous dispersions or solid compositions releasably affixed to a solid carrier.

22 Claims, No Drawings

FABRIC SOFTENING AND ANTI-STATIC COMPOSITIONS CONTAINING A QUATERNIZED DI-SUBSTITUTED IMIDAZOLINE ESTER FABRIC SOFTENING COMPOUND WITH A NONIONIC FABRIC SOFTENING COMPOUND

This is a continuation-in-part of application Ser. No. 07/403,549, filed on Sep. 6, 1989, now abandoned.

TECHNICAL FIELD

The present invention relates to fabric softening and anti-static compositions containing a quaternized di-substituted imidazoline ester fabric conditioning compound and a nonionic fabric conditioning compound. In particular, it relates to fabric softening and anti-static compositions which possess desirable storage-stability, viscosity, and fabric softening and antistatic properties and are especially suitable for use in the rinse cycle of a textile laundering operation.

BACKGROUND OF THE INVENTION

Many different types of fabric conditioning agents have been used in fabric treatment compositions. One class of compounds frequently used as the active component for such compositions includes substantially water-insoluble quaternary nitrogenous compounds having two long alkyl chains. Typical of such materials are ditallow dimethyl ammonium chloride and imidazoline and imidazolinium compounds substituted with two long chain alkyl groups. These materials are normally prepared in the form of an aqueous dispersion.

The use of substituted imidazoline compounds as fabric conditioning agents is known. Imidazoline salts have been used by themselves or in combination with other agents in the treatment of fabrics. British patent specification 1,565,808, Apr. 23, 1980, assigned to Hoechst Aktiengesellschaft, discloses a textile fabric softener composition consisting of an aqueous solution or dispersion of an imidazoline or salt thereof, or a mixture of such imidazolines or salts thereof. The imidazoline disclosed in the Hoechst patent may have one alkyl chain interrupted by an ester linkage. U.S. Pat. No. 4,724,089, Feb. 9, 1988, to Konig et al., discloses fabric treatment compositions containing dialkyl imidazoline compounds, or salts thereof, which may have one alkyl chain interrupted by an ester linkage. U.S. Pat. No. 4,806,255, Feb. 21, 1989, to Konig et al., discloses an aqueous fabric conditioning composition comprising a di(higher alkyl)cyclic amine and a quaternary ammonium softening agent having two higher alkyl groups linked to the quaternary nitrogen atom. U.S. Pat. No. 4,661,269, Apr. 28, 1987, to Trinh et al., discloses rinse-added liquid fabric softening compositions containing the reaction products of higher fatty acids and polyamines, cationic nitrogenous salts having only one long chain acyclic aliphatic hydrocarbon group, and optionally cationic nitrogenous salts having two or more long chain acyclic aliphatic hydrocarbon groups or one said group and an arylalkyl group. One potential reaction product of a higher fatty acid and polyamine includes an imidazoline ester compound.

The use of both imidazolinium amide and imidazolinium ester salts as fabric conditioning agents is also known. U.S. Pat. No. 2,874,074, Feb. 17, 1959, to Johnson discloses using imidazolinium salts to condition fabrics. The disclosed imidazolinium salts may have one alkyl chain interrupted by an ester linkage. U.S. Pat. No. 3,689,424, Sep. 5, 1972, to Berg et al., discloses detergent compositions containing a textile softener composition which may contain quaternary ammonium compounds containing two alkyl groups. One of the quaternary ammonium compounds disclosed is a substituted imidazolinium salt with one alkyl chain interrupted by an ester linkage. U.S. Pat. No. 3,681,241, Aug. 1, 1972 to Rudy discloses fabric conditioning compositions containing a mixture of amide imidazolinium salts and other cationic fabric conditioning agents. U.S. Pat. No. 4,661,269, Apr. 28, 1987, to Trinh et al., discussed above, discloses as an optional component an imidazolinium amide compound.

U.S. Pat. No. 4,233,451, Nov. 11, 1980, to Pracht et al., and U.S. Pat. No. 4,127,489, Nov. 28, 1978, to Pracht et al., disclose fabric softening compositions containing di-substituted imidazolinium compounds, which may have one alkyl chain interrupted by an ester linkage, in combination with other fabric conditioning agents, including quaternary ammonium compounds having one or two straight chain organic groups with at least 8 carbon atoms.

None of these references, however, disclose combining quaternary imidazoline ester salts with certain other nonionic fabric conditioning agents, such as ester-containing nonionic compounds, and the associated desirable storage-stability, viscosity and fabric conditioning properties realized therein.

It is therefore an object of the present invention to provide a fabric softening and anti-static composition which exhibits improved softener performance and phase stability through the combination of an imidazolinium ester salt and a nonionic fabric conditioning compound.

It is another object of this invention to provide a method for conditioning fabrics with aqueous dispersions containing a quaternary imidazoline ester compound and a nonionic fabric conditioning compound.

It is still another object of this invention to provide a method for conditioning fabrics by treating them with particular textile treatment compositions containing the ingredients described herein and which are in solid form. Such solid compositions are releasably affixed to sheet materials which can be used in hot air clothes dryers.

These objects are realized by the present invention.

SUMMARY OF THE INVENTION

The present invention is directed to a liquid fabric softening and anti-static composition comprising:

(a) from about 1% to about 30% by weight of a quaternized di-substituted imidazoline ester softener compound of the formula

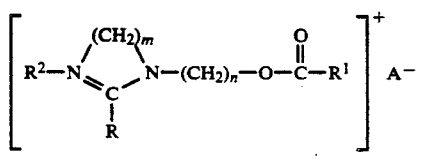

(I)

or

-continued

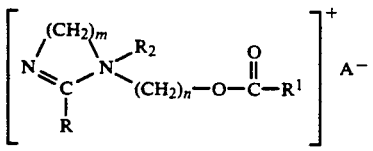

(II)

or mixtures thereof, wherein R and $R^1$ are, independently, $C_{11}$–$C_{21}$ hydrocarbyl groups, $R^2$ is a $C_1$–$C_4$ hydrocarbyl group, $A^-$ is an anion, and m and n are, independently, from about 2 to about 4 inclusive;

(b) from about 1% to about 30% by weight of a nonionic fabric softener compound; and (c) a liquid carrier.

The fabric softening and anti-static compositions of the present invention may also be in solid form and releasably affixed to a solid carrier.

DETAILED DESCRIPTION OF THE INVENTION

The compositions of the present invention comprise a mixture of a quaternary imidazoline ester compound with a nonionic fabric softening compound, wherein said mixture may be in a liquid carrier or releasably affixed to a solid carrier. The compositions of the present invention may be used for fabric treatment application, both in formulations containing only fabric softener actives and in formulations containing detergents and fabric softener actives, as well as in hair conditioning applications.

Quaternized Imidazoline-ester Softening Compound

The present invention contains as an essential component from about 1% to about 30% by weight, preferably from about 2% to about 20% by weight, most preferably from about 3% to about 8% by weight, of a quaternized di-substituted imidazoline ester softening compound of the formula

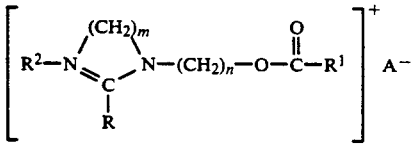

(I)

or

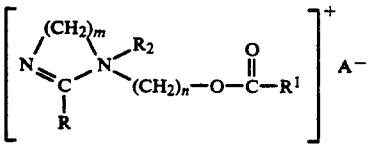

(II)

or mixtures thereof, wherein R and $R^1$ are, independently, a $C_{11}$–$C_{21}$ hydrocarbyl group, preferably a $C_{13}$–$C_{17}$ alkyl group, most preferably a straight chained $C_{17}$ alkyl group; $R^2$ is a $C_1$–$C_4$ hydrocarbyl group, preferably a $C_1$–$C_3$ alkyl, alkenyl or hydroxyalkyl group, e.g., methyl (most preferred), ethyl, propyl, propenyl, hydroxyethyl, 2-, 3-di-hydroxypropyl and the like; and m and n are, independently, from about 2 to about 4, preferably about 2. The counterion $A^-$ is not critical herein, and can be any softener compatible anion, for example, chloride, bromide, methylsulfate, ethylsulfate, formate, sulfate, nitrate and the like. Examples of such quaternized di-substituted imidazoline compounds include 1-ethyl stearate-2-hepatadecyl-3-methyl imidazolinium chloride, 1-ethyl stearate-2-heptadecyl-3-methyl imidazolinium bromide, 1-ethyl stearate-2-heptadecyl-3-methyl imidazolinium idodide, 1-ethyl stearate-2-heptadecyl-3-methyl imidazolinium methyl sulfate, 1-ethyl stearate-2-heptadecyl-3-ethyl imidazolinium chloride, 1-ethyl stearate-2-heptadecyl-3-ethyl imidazolinium bromide, 1-ethyl stearate-2-heptadecyl-3-ethyl imidazolinium idodide, 1-ethyl stearate-2-heptadecyl-3-ethyl imidazolinium ethyl sulfate, 1-ethyl tallow-2-tallow-3-methyl imidazolinium chloride, 1-ethyl tallow-2-tallow-3-methyl imidazolinium bromide, 1-ethyl tallow-2-tallow-3-methyl imidazolinium idodide, 1-ethyl tallow-2-tallow-3-methyl imidazolinium methyl sulfate, 1-ethyl tallow-2-tallow-3-ethyl imidazolinium chloride, 1-ethyl tallow-2-tallow-3-ethyl imidazolinium bromide, 1-ethyl tallow-2-tallow-3-ethyl imidazolinium idodide, 1-ethyl tallow-2-tallow-3-ethyl imidazolinium ethyl sulfate, 1-ethyl octadecyl-2-heptadecyl-3-methyl imidazolinium chloride, 1-ethyl octadecyl-2-heptadecyl-3-methyl imidazolinium bromide, 1-ethyl octadecyl-2-heptadecyl-3-methyl imidazolinium idodide, 1-ethyl octadecyl-2-heptadecyl-3-methyl imidazolinium methyl sulfate, 1-ethyl octadecyl-2-heptadecyl-3-ethyl imidazolinium chloride, 1-ethyl octadecyl-2-heptadecyl-3-ethyl imidazolinium bromide, 1-ethyl octadecyl-2-heptadecyl-3-ethyl imidazolinium idodide, 1-ethyl octadecyl-2-heptadecyl-3-ethyl imidazolinium ethyl sulfate, 1-ethyl hexadecyl-2-pentadecyl-3-methyl imidazolinium chloride, 1-ethyl hexadecyl-2-pentadecyl-3-methyl imidazolinium bromide, 1-ethyl hexadecyl-2-pentadecyl-3-methyl imidazolinium idodide, 1-ethyl hexadecyl-2-pentadecyl-3-methyl imidazolinium methyl sulfate, 1-ethyl hexadecyl-2-pentadecyl-3-ethyl imidazolinium chloride, 1-ethyl hexadecyl-2-pentadecyl-3-ethyl imidazolinium bromide, 1-ethyl hexadecyl-2-pentadecyl-3-ethyl imidazolinium idodide, and 1-ethyl hexadecyl-2-pentadecyl-3-ethyl imidazolinium ethyl sulfate.

The above compounds used as a softener active and anti-static ingredient in the practice of this invention can be prepared by quaternizing a substituted imidazoline ester compound.

Quaternization may be achieved by any known quaternization method. A preferred quaternization method is disclosed in copending U.S. application Ser. No. 07/403,541, "Process for Preparing Quaternized Imidazoline Fabric Conditioning Compounds," filed Sep. 6, 1989, by Theresa Rosario-Jansen and Glen D. Lichtenwalter, the disclosure of which is incorporated herein by reference. In the quaternization process disclosed in the copending reference, a substituted imidazoline ester compound is initially liquified at a temperature ranging from about 50° to about 100° C., preferably from about 70° C. to about 85°·C., to form an anhydrous melt. The anhydrous melt is then contacted, in conjunction with agitation and under anhydrous conditions, with a quaternizing agent selected from the group consisting of $C_1$–$C_4$ halides, benzyl halides, dimethylsulfate, diethylsulfate, and propylsulfate. Preferred quaternizing agents include methylchloride (most preferred), dimethylsulfate and diethylsulfate. The manner of contacting the quaternizing agent with the liquid imidazoline ester is dependent upon the phase of the quaternizing agent at reaction temperature. Gaseous quaternizing agents are either bubbled through the liquified imidazoline ester compound or charged into a sealed reactor chamber with the liquified imidazoline ester compound. The reaction time necessary for quaternization ranges from about 1 to about 4 hours. The amount of quaternizing agent to imidazoline ester compound is dependent upon the ratio of quaternary imidazoline ester compound to nonionic softener compound desired in the reaction mixture.

In a preferred method of preparing the compositions of the present invention, the quaternization method disclosed in the Rosario-Jansen/Lichtenwalter patent application is carried using a di-substituted imidazoline ester nonionic fabric softener compound. This di-substituted imidazoline ester compound is then reacted with a quaternizing agent under the conditions disclosed by the Rosario-Jansen/Lichtenwalter patent application for a period of time sufficient to form a reaction product, wherein said reaction product contains from about 1 to about 99 mole percent, preferably from about 30 to about 90 mole percent, most preferably from about 40 to about 80 mole percent, of a quaternized di-substituted imidazoline ester compound and from about 99 to about 1 mole percent, preferably from about 70 to about 10 mole percent, most preferably from about 60 to about 20 mole percent, of the initial di-substituted imidazoline ester reactant. Any quaternizing agent present in the reaction product is removed by methods known in the art, such as distillation. A composition of the present invention may then be prepared by directly diluting the reaction product with a liquid carrier. The reaction product may also be solidified (e.g., by cooling) and releasably affixed to a solid carrier.

The imidazoline ester compound which is quaternized may be prepared using known methods. A preferred method is a two-step synthesis process disclosed in pending U.S. patent application Ser. No. 07/288,044, filed Dec. 21, 1988, the disclosure of which is incorporated herein by reference. In the synthesis process disclosed in this reference, an acylating agent selected from fatty acids, fatty acid halides, fatty acids anhydrides, or fatty acid short chain esters, is reacted with a polyamine to form a monosubstituted imidazoline intermediate compound. In the second process step the imidazoline intermediate is further reacted with an esterifying agent selected from a monoester of fatty acids and fatty acid mono-, di- and triglycerides. The resulting product is a di-substituted imidazoline ester compound. This two-stage process for preparing a di-substituted imidazoline ester compound may be improved by carrying out the esterifying step in the presence of a catalytically effective amount of transesterification catalyst, as disclosed in pending U.S. patent application Ser. No. 07/287,922, filed Dec. 21, 1988.

The quaternized di-substituted imidazoline ester compounds contained in the compositions of the present invention are believed to be biodegradable and susceptible to hydrolysis due to the ester group on the alkyl substituent. Furthermore, the imidazoline compounds contained in the compositions of the present invention are susceptible to ring opening under certain conditions. As such, care should be taken to handle these compounds under conditions which avoid these consequences. For example, stable liquid compositions herein are preferably formulated at a pH in the range of about 1.5 to about 5.0, most preferably at a pH ranging from about 1.8 to 3.5. The pH can be adjusted by the addition of a Bronsted acid. Examples of suitable Bronsted acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, benzoic, methylsulfonic and ethylsulfonic acid. Preferred acids are hydrochloric and phosphoric acids. Additionally, compositions containing these compounds should be maintained substantially free of unprotonated, acyclic amines.

Nonionic Fabric Softening Compound

The present invention contains as an essential component from about 1% to about 30% by weight, preferably from about 2% to about 20% by weight, most preferably from about 2% to about 8% by weight, of a nonionic, preferably ester-containing, fabric softening compound. The nonionic fabric softening compound used herein may be selected from any known nonionic fabric softening compounds. Examples of nonionic fabric softening compounds useful herein include amides, di-substituted imidazolines, and higher mono- and di-glycerides.

One type of preferred nonionic fabric softening compounds are di-substituted imidazolines. Examples of preferred di-substituted imidazoline fabric softening compounds are of the formula:

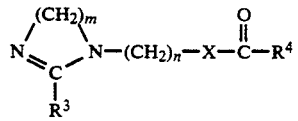

(III)

wherein $R^3$ and $R^4$ independently, a $C_{11}$–$C_{21}$ hydrocarbyl group, preferably a $C_{13}$–$C_{17}$ alkyl group, most preferably a straight chained $C_{15}$–$C_{17}$ alkyl group, m and n are, independently, from about 2 to about 4, preferably m and n are both 2, and X is either O (preferred), S, or $NR^5$, wherein $R^5$ is H or a $C_1$–$C_4$ alkyl group. It will be understood that substituents $R^3$ and $R^4$ may optionally be substituted with various groups, such as alkoxy or hydroxyl groups, or alternatively can be branched, but such materials are not preferred herein. In addition, $R^3$ and $R^4$ may optionally be unsaturated (i.e., alkenyl groups).

Examples of di-substituted imidazoline derivatives wherein X is NH include stearyl amido ethyl-2-stearyl imidazoline, stearyl amido ethyl-2-palmityl imidazoline, stearyl amido ethyl-2-myristyl imidazoline, palmityl amido ethyl-2-palmityl imidazoline, palmityl amido ethyl-2-myristyl imidazoline, stearyl amido ethyl-2-tallow imidazoline, myristyl amido ethyl-2-tallow imidazoline, palmityl amido ethyl-2-tallow imidazoline, coconut amido ethyl-2-coconut imidazoline, tallowamido ethyl-2-tallow imidazoline, and mixtures of such imidazoline compounds.

Examples of di-substituted imidazoline derivatives wherein X is S (sulfur) include stearylthiolethyl-2-stearyl imidazoline, stearylthiolethyl-2-palmityl imidazoline, stearylthiolethyl-2-myristyl imidazoline, palmitylthiolethyl-2-palmityl imidazoline, palmitylthiolethyl-2-myristyl imidazoline, palmitylthiolethyl-2-tallow imidazoline, myristylthiolethyl-2-tallow imidazoline, stearylthiolethyl-2-tallow imidazoline, coconut thiolethyl-2-coconut imidazoline, tallowthiolethyl-2-tallow imidazoline, and mixtures of such compounds.

The most preferred nonionic fabric softening compounds are di-substituted imidazoline ester compounds of the formula

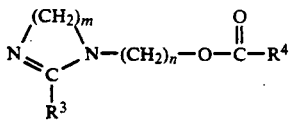

(IV)

wherein $R^3$, $R^4$, m and n are as hereinbefore defined.

Examples of di-substituted imidazoline ester compounds which may be prepared by the methods disclosed in either of these pending applications include stearoyl oxyethyl-2-stearyl imidazoline, stearoyl oxyethyl-2-palmityl imidazoline, stearoyl oxyethyl-2-myristyl imidazoline, palmitoyl oxyethyl-2-palmityl imidazoline, palmitoyl oxyethyl-2-myristyl imidazoline, stearoyl oxyethyl-2-tallow imidazoline, myristoyl oxyethyl-2-tallow imidazoline, palmitoyl oxyethyl-2-tallow imidazoline, coconut esters of oxyethyl-2-coconut imidazoline, and tallow esters of oxyethyl-2-tallow imidazoline.

As with the quaternized softener compound of the present invention, these most preferred compounds are believed to be biodegradable due to the ester group contained on the long chain alkyl substituent. This ester moiety is also believed to enhance the rate of hydrolysis of the softener compound. As such, compositions containing these preferred nonionic compounds should be handled in the manner already disclosed herein for compositions containing the quaternized di-substituted imidazoline ester softening compound, i.e., maintaining the composition pH within the range of 1.5 to 5.0, preferably within the range of 1.8 to 3.5, and free of unprotonated, acyclic amines.

The preferred di-substituted imidazoline compounds useful herein as the nonionic fabric conditioning compound of the present invention may be prepared using standard reaction chemistry. For example, in a typical synthesis a fatty acid of the formula $R^3COOH$ is reacted with a polyamine of the general formula $NH_2—(CH_2)_m—NH—(CH_2)_n—X—H$, wherein $R^3$, m, n and X are as hereinbefore defined, to form an intermediate imidazoline. The intermediate is then reacted with a methyl ester of the fatty acid of the formula $R^4COOCH_3$, wherein $R^4$ is as hereinbefore defined, to yield the desired reaction product. The preferred method of synthesis for the substituted imidazoline compounds is as already disclosed herein for preparing the di-substituted imidazoline ester compound to be quaternized. However, it will be appreciated by those skilled in the chemical arts that this reaction sequence allows a broad selection of compounds to be prepared.

Liquid Carrier

The compositions of the present invention are also comprised of a liquid carrier, e.g., water, $C_1$–$C_4$ monohydric alcohol, e.g., ethanol, propanol, isopropanol, butanol, with isoproponal being preferred, and mixtures thereof. These compositions comprise from about 40% to about 99% by weight, preferably from about 70% to about 90% by weight, of the liquid carrier. The preferred composition contains a mixture of water and a $C_1$–$C_4$ monohydric alcohol, with the preferred amount of $C_1$–$C_4$ monohydric alcohol in the liquid carrier ranging from about 0.1% to about 10% by weight of the softening actives. It should be noted that any lower alcohol solvents included in the composition should be added after quaternization of the imidazoline ester compound, as the presence of such solvents during quaternization reduces product yield and purity.

The softening compounds used in this invention are insoluble in water-based carriers, and thus are present as a dispersion of fine particles therein. These particles are preferably submicron in size, most preferably having an average diameter ranging from about 0.1 to about 0.5 micron, and are conventionally prepared by high shear mixing.

The particle dispersion of the foregoing type can optionally be stabilized against settling by means of standard non-base emulsifiers, especially nonionic extenders, such as sorbitan monostearate. Such nonionic and their usage levels have been disclosed in U.S. Pat. No. 4,454,049, Jun. 12, 1984, to MacGilp et al., the disclosure of which is incorporated herein by reference.

Specific examples of nonionic extenders suitable for use in the compositions herein include glycerol esters (preferably glycerol monostearate), fatty alcohols, (e.g., stearyl alcohol), and ethoxylated linear alcohols (preferably Neodol 23-3, which is the condensation product of a $C_{12}$–$C_{13}$ linear alcohol with 3 moles ethylene oxide, and is marketed by the Shell Chemical Company) and mixtures thereof. Mixtures of glycerol monostearate and Neodol 23-3 are particularly preferred. Generally, such nonionic extender will comprise from about 0.1% to about 10% by weight of the composition.

Solid Carrier

Solid carrier materials can be used in place of liquid carriers. For example, the softener compounds herein can be absorbed on particulate solids such as potassium sulfate, micronized silica, powdered urea, and the like, and added to a laundry rinse bath. Alternatively, the softeners can be releasably padded onto a sheet (e.g., paper toweling, nonwoven fabric, or the like) and tumbled with damp fabrics in a hot-air clothes dryer, in the manner of the BOUNCE® brand dryer-added product known in commercial practice. Such solid-form compositions and carrier materials have been disclosed in U.S. Pat. No. 3,442,692, May 6, 1969, to Gaiser, the disclosure of which is incorporated herein by reference. Generally, such solid-form compositions will comprise from about 1% to about 20% of the biodegradable fabric softening compounds, and from about 80% to about 99% of the solid carrier.

Optional Ingredients

Fully formulated fabric softening compositions of the present invention may optionally contain a variety of additional ingredients including, but not limited to, one or more of the following.

Ouaternized Ester-ammonium Softening Compounds

The compositions of the present invention may optionally contain quaternized ester ammonium softening compounds. Such compounds may be of the general formulas

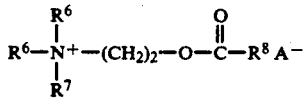

(V)

or

-continued

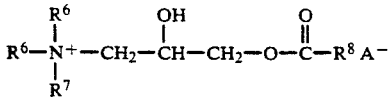

(VI)

or

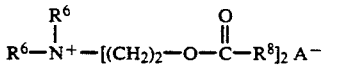

(VII)

wherein each $R^6$ substituent is a $C_1$–$C_6$ hydrocarbyl group, preferably a $C_1$–$C_3$ alkyl group, $R^7$ is either a short chain hydrocarbyl group or a $C_{14}$–$C_{22}$ hydrocarbyl group, and $R^8$ is a long chain $C_{13}$–$C_{21}$ hydrocarbyl group. The counterion $A^-$ is not critical herein, and can be any softener compatible ion, for example, chloride, bromide, methylsulfate, formate, sulfate, nitrate and the like. It will be understood that substituents $R^6$, $R^7$, and $R^8$ may optionally be substituted with various groups such as alkoxy or hydroxyl groups, or can be branched, but such materials are not preferred herein. In addition, $R^6$, $R^7$, and $R^8$ may optionally be unsaturated (i.e., alkenyl groups). The preferred compounds can be considered to be mono-ester variations of ditallow dimethyl ammonium salts (e.g., DTDMAC, a widely used fabric softening compound).

As illustrative non-limiting examples of quaternized ester-ammonium softening compounds, are the following formulas $[CH_3]_2[C_{18}H_{37}]^+NCH_2CH_2OC(O)C_{17}H_{35}Br^-$ $[CH_3]_2[C_{16}H_{33}]^+NCH_2CH_2OC(O)C_{15}H_{31}Cl^-$ $[C_2H_5]_2[C_{17}H_{35}]^+NCH_2CH_2OC(O)C_{15}H_{31}Cl^-$ $[C_2H_5][CH_3][C_{18}H_{37}]^+NCH_2CH_2OC(O)C_{17}H_{35}CH_3SO_4^-$ $[C_3H_7][C_2H_5][C_{16}H_{33}]^+NCH_2CH_2OC(O)C_{15}H_{31}Cl^-$ $[iso\text{-}C_3H_7][CH_3][C_{18}H_{37}]^+NCH_2CH_2OC(O)C_{15}H_{31}I^-$ Illustrative, non-limiting examples of useful quaternized 2-hydroxypropyl monoester ammonium salts (wherein all long chained alkyl substituents are straight chained) include:

$[CH_3]_2[C_{18}H_{37}]^+NCH_2CH(OH)CH_2OC(O)C_{17}H_{35}Br^-$ $[CH_3]_2[C_{16}H_{33}]^+NCH_2CH(OH)CH_2OC(O)C_{15}H_{31}Cl^-$ $[C_2H_5]_2[C_{17}H_{35}]^+NCH_2CH(OH)CH_2OC(O)C_{15}H_{31}Cl^-$ $[C_2H_5][CH_3][C_{18}H_{37}]^+NCH_2CH(OH)CH_2OC(O)C_{17}H_{35}CH_3SO_4^-$ $[C_3H_7][C_2H_5][C_{16}H_{33}]^+NCH_2CH(OH)CH_2OC(O)C_{15}H_{31}Cl^-$ $[iso\text{-}C_3H_7][CH_3][C_{18}H_{37}]^+NCH_2CH(OH)CH_2OC(O)C_{15}H_{31}I^-$ The foregoing ester ammonium compounds are somewhat labile to hydrolysis and should be handled rather carefully when used to formulate the compositions herein. Therefore, the pH of the compositions should be adjusted to within the ranges already disclosed herein. Adjustment of the pH may be accomplished by the methods already disclosed herein.

Conventional Quaternary Ammonium Softening Agents

The compositions of the present invention can further comprise a conventional mono- and di(higher alkyl) quaternary ammonium softening agent. The compositions herein can contain from 0% to about 25% (preferably from about 0.1% to about 10%) of the conventional di(higher alkyl)quaternary ammonium softening agent.

"Higher alkyl", as used in the context of the conventional quaternary ammonium salts herein, means alkyl groups having from about 8 to about 30 carbon atoms, preferably from about 11 to about 22 carbon atoms. Examples of such conventional quaternary ammonium salts include:

(i) acyclic quaternary ammonium salts of the formula:

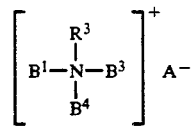

(VIII)

wherein $B^1$ is a $C_{14}$–$C_{22}$ hydrocarbyl group, $B^3$ is a $C_1$–$C_4$ saturated alkyl or hydroxyalkyl group, $B^4$ is selected from $(CH_3)_2OH$, $B^1$ and $B^3$, and A is an anion;

(ii) quaternary ammonium salts of the formula:

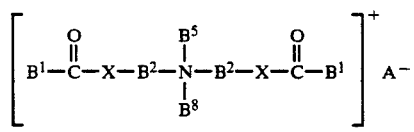

(IX)

wherein $B^1$ is an acyclic aliphatic $C_{15}$–$C_{22}$ hydrocarbon group, $B^2$ is a divalent alkylene group having 1 to 3 carbon atoms, $B^5$ and $B^8$ are $C_1$–$C_4$ saturated alkyl or hydroxyalkyl groups, X is NH or O, preferably O, and A is an anion;

(iii) alkoxylated quaternary ammonium salts of the formula:

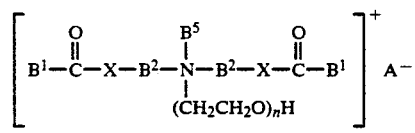

(X)

wherein n is equal to from about 1 to about 5, and $B^1$, $B^2$, $B^5$, X and A are as defined above;

Examples of component (i) are the well-known mono- and dialkyl, di- and trimethyl ammonium salts such as monotallow trimethyl ammonium chloride (MTTMAC), ditallow dimethyl ammonium chloride, ditallow dimethyl ammonium methylsulfate, di(hydrogenated tallow) dimethyl ammonium chloride, dibehenyl dimethyl ammonium chloride, and tallow dimethyl (2-hydroxyethyl) ammonium chloride.

Examples of components (ii) and (iii) are methylbis(tallow amidoethyl) (2-hydroxyethyl) ammonium methylsulfate and methylbis (hydrogenated tallowamidoethyl) (2-hydroxyethyl) ammonium methylsulfate. These materials are available from Sherex Chemical Company, located in Dublin, Ohio under the trade names Varisoft ® 222 and Varisoft ® 110, respectively.

Preferred conventional quaternary ammonium softening agents include MTTMAC and tallow dimethyl (2-hydroxyethyl) ammonium chloride The MTTMAC compound is especially preferred when used in rinse-added fabric softening compositions which are added to the rinse cycle following washings in detergents such as ALL ®, TIDE ® and WISK ®. A preferred concentration of MTTMAC ranges from about 0.1% to about 3.0% by weight, with the most preferred concentration ranging from about 0.3% to about 1.4% by weight.

Free amines

As already stated herein, the liquid compositions herein should be substantially free (generally less than about 0.1%) of free (i.e., unprotonated) amines.

Minor amounts of protonated amines, typically from about 0.05% to about 0.1%, namely primary, secondary and tertiary amines having, at least, one straight-chain organic group of from about 12 to about 22 carbon atoms may be used in the compositions of the present invention as emulsifiers to enhance dispersion stability. Examples of amines of this class are ethoxyamines, such as monotallow dipolyethoxyamine, having a total of from about 2 to about 30 ethoxy groups per molecule. Other such amines include diamines such as tallow-N,N',N'-tris (2-hydroxyethyl)-1,3-propylenediamine (Jet Amine DT-3, marketed by Jetco Chemicals, Inc., located in Corsicanna, Tex.) or $C_{16}$–$C_{18}$-alkyl-N-bis(2-hydroxyethyl)amines (e.g., Jet Amine PHT-2, marketed by Jetco Chemicals Inc.). Examples of the above compounds are those marketed under the trade names GENAMIN C, S, O and T, by American Hoechst Corporation, located in Sommerset, N.J.

It is preferred that emulsifiers selected from such amines not be included in the compositions of this invention. If such amine emulsifiers are included, care must be taken to ensure that amines are protonated with acid during formulation in order to minimize hydrolysis of the fabric softening compounds disclosed herein.

Silicone Component

The present compositions may contain silicones to provide additional benefits such as ease of ironing and improved fabric feel. The preferred silicones are polydimethylsiloxanes of viscosity of from about 100 centistokes (cs) to about 100,000 cs, preferably from about 200 cs to about 60,000 cs. These silicones can be used as is, or can be conveniently added to the softener compositions in a preemulsified form which is obtainable directly from the suppliers. Examples of these preemulsified silicones are 60% emulsion of polydimethylsiloxane (350 cs) sold by Dow Corning Corporation, located in Midland, Mich., under the trade name Dow Corning® 1157 Fluid, a 50% emulsion of polydimethylsiloxane (10,000 cs) sold by General Electric Company, located in Waterford, N.Y., under the trade name General Electric® SM 2140 Silicones, and Silicone® DC 1520, sold by Dow Corning Corporation. The optional silicone component can be used in an amount of from about 0.01% to about 6% by weight of the composition.

Thickening Agent

Optionally, the compositions herein contain from about 0.01% to about 3%, preferably from about 0.01% to about 2%, of a thickening agent. Examples of suitable thickening agents include: cellulose derivatives, synthetic high molecular weight polymers (e.g., carboxyvinyl polymer and polyvinyl alcohol), and cationic guar gums.

The cellulosic derivatives that are functional as thickening agents herein may be characterized as certain hydroxyethers of a cellulose, such as Methocel®, marketed by Dow Chemical U.S.A./The Dow Chemical Company, located in Midland, Mich., and certain cationic cellulose ether derivatives, such as Polymer® JR-125, JR-400®, and JR-30M®, marketed by Union Carbide Corporation, located in Sommerset, N.J.

Other effective thickening agents are cationic guar gums, such as Gendrive® 458, marketed by General Mills, located in Minneapolis, Minn.

Preferred thickening agents herein are selected from the group consisting of methyl cellulose, hydroxypropyl methylcellulose, hydroxybutyl methylcellulose, or mixtures thereof, said cellulosic polymer having a viscosity in 2% aqueous solution at 20° C. of from about 15 to about 75,000 centipoise.

Soil Release Agent

Optionally, the compositions herein contain from about 0.1% to about 10%, preferably from about 0.2% to about 5%, of a soil release agent. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from E.I. du Pont de Nemours & Company, located in Wilmington, Del.) and Milease® T (from ICI Americas, Inc., located in Wilmington, Del.).

Highly preferred soil release agents are polymers of the generic formula:

$$X-(OCH_2CH_2)_n(O-\overset{O}{\overset{\|}{C}}-D^1-\overset{O}{\overset{\|}{C}}-OD^2)_u(O-\overset{O}{\overset{\|}{C}}-D^1-\overset{O}{\overset{\|}{C}}-O)_u(CH_2CH_2O)_n-X$$

in which X can be any suitable capping group, with each X being selected from the group consisting of H and alkyl or acyl groups containing from about 1 to about 4 carbon atoms, n is selected for water solubility and generally is from about 6 to about 113, preferably from about 20 to about 50, and u is critical to formulation in a liquid composition having a relatively high ionic strength. There should be very little material in which u is greater than 10. Furthermore, there should be at least 20%, preferably at least 40%, of material in which u ranges from about 3 to about 5.

The $D^1$ moieties are essentially 1,4-phenylene moieties. As used herein, the term "the $D^1$ moieties are essentially 1,4-phenylene moieties" refers to compounds where the $D^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $D^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $D^1$ comprise from about 50% to about 100% 1,4-phenylene moieties (from 0 to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $D^1$ moieties consist entirely of (i.e., comprise 100%) 1,4-phenylene moieties, i.e., each $D^1$ moiety is 1,4-phenylene.

For the $D^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $D^2$ moieties are essentially ethylene moieties, 1,2-propylene moieties or mixtures thereof. Inclusion of a greater percentage of ethylene moieties tends to improve the soil release activity of compounds. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the soil release component in the liquid fabric softener compositions. Preferably, from about 75% to about 100%, more preferably from about 90% to about 100%, of the $D^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these highly preferred soil release agents is contained in European Patent Application 185,427, Gosselink, published Jun. 25, 1986, incorporated herein by reference.

Viscosity Control Agents

Viscosity control agents can be used in the compositions of the present invention (preferably in concentrated compositions). Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts include sodium citrate and the halides of the group IA and IIA metals of the Periodic Table of the Elements, e.g., calcium chloride, magnesium chloride, sodium chloride, potassium bromide, lithium chloride, and mixtures thereof. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 10 to about 3,000 parts per million (ppm), preferably from about 10 to about 2,000 ppm, by weight of the composition.

In addition to their role as viscosity agents, the ionizable salts mentioned above also function as electrolytes and can further improve the stability of the compositions herein. A highly preferred electrolyte is calcium chloride. Typical levels of use of the electrolyte are from about 10 to about 3,000 parts per million (ppm), preferably from about 10 to about 2,000 ppm by weight of the compositions.

Bactericides

Examples of bactericides used in the compositions of this invention include glutaraldehyde, formaldehyde, 2-bromo-2-nitropropane-1,3-diol sold by Inolex Chemicals, located in Philadelphia, Pa., under the trade name Bronopol ®, and a mixture of 5-chloro-2-methyl-4-isothiazoline-3-one and 2-methyl-4-isothiazoline-3-one sold by the Rohm and Haas Company, located in Philadelphia, Pa., Company under the trade name Kathon ® CG/ICP. Typical levels of bactericides used in the present compositions are from about 1 to about 1,000 ppm by weight of the composition.

Other Optional Ingredients

The present invention can include other optional components conventionally used in fabric softening and anti-static compositions, for example, colorants, perfumes, preservatives, optical brighteners, opacifiers, fabric conditioning agents, surfactants, stabilizers such as guar gum and polyethylene glycol, anti-shrinkage agents, anti-wrinkle agents, fabric crisping agents, spotting agents, germicides, fungicides, anti-oxidants such as butylated hydroxy toluene, anti-corrosion agents, clays (when a solid composition is releasably affixed to a solid carrier) and the like.

In the method aspect of this invention, fabrics or fibers (including hair) are contacted with an effective amount, generally from about 20 ml to about 300 ml (per 2.5 kg of fiber or fabric being treated), of the compositions herein in an aqueous bath. Of course, the amount used is based upon the judgment of the user, depending on concentration of the composition, fiber or fabric type, degree of softness desired, and the like. Typically, about 50–100 ml. of an 8% dispersion of the softening compound in a 83 l laundry rinse bath to soften and provide antistatic benefits to a 2.5 kg load of mixed fabrics. Preferably, the rinse bath contains from about 48 ppm to about 96 ppm of the fabric softening compositions herein.

Compositions containing the quaternized di-substituted imidazoline ester compounds and non-ionic softening compounds of the present invention are also useful in hair conditioning applications. Such compositions typically comprise from about 1% by 30% by weight of each compound in an aqueous dispersion.

The following examples illustrate the practice of the present invention but are not intended to be limiting thereof.

EXAMPLE I

A storage-stable, liquid fabric-softening composition of the present invention is made as follows:

| Ingredient | Percent (wt.) |
|---|---|
| (I) 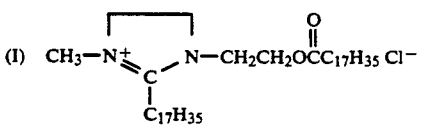 | 4.8% |
| (II) 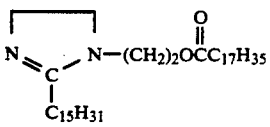 | 3.2% |
| HCl | 0.2% |
| Dye | 20 ppm |
| Water | Balance |

24.0 g of quaternary softener compound (I) and 16.0 g of imidazoline ester compound (II) are heated together at 80° C. to form a fluidized homogeneous "melt". The melt is then poured, with stirring, into 420.0 g of hot (70° C.) water containing 20 ppm dye. The pH of the water seat is adjusted to 2.8 prior to the addition of the melt using 1.0N HCl. Midway through the addition of the melt to the water seat, half of the remaining HCl is added to the water seat and melt mixture. The resulting mixture is stirred an additional 5 minutes using a low-shear propeller blade mixer. The remaining HCl is added to the mixture after 4 minutes of stirring, thus adjusting the mixture pH to about 2.8. The mixture is sheared for 1 minute with high-shear mixing (using a Tekmar mixer, marketed by the Tekmar Company, located in Cincinnati, Ohio, at 7,000 rpm). The softener actives of the resulting mixture have a typical average particle size of about 0.2–0.3 micron and are dispersed in an aqueous composition. The aqueous composition has a viscosity of about 30 centipoise (@25° C.).

EXAMPLE II

A storage-stable, liquid fabric-softening composition which maintains excellent softening characteristics in the presence of anionic surfactant carryover is made as follows:

| Ingredient | Percent (wt.) |
|---|---|
| (I) 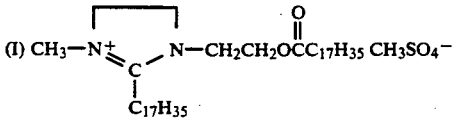 | 4.20% |
| (II) 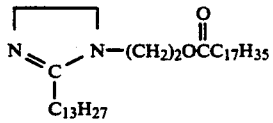 | 2.75% |
| Monotallow trimethyl ammonium chloride (MTTMAC) | 0.66% |
| Dye | 20 ppm |
| Polydimethylsiloxane (PDMS) | 0.32% |
| Silicone DC 1520 | 0.01% |
| HCl | 0.15% |
| Water | Balance |

84.00 g of quaternary softener compound (I) and 55.00 g of imidazoline ester compound (II) are heated together at 70° C. to form a fluidized homogeneous "melt". The melt is then poured, with stirring, into 1760.00 g of hot (70° C. ) water containing 20 ppm dye. The pH of the water seat is adjusted to 2.8 prior to the addition of the melt using 1.0N HCl. Midway through the addition of the melt to the water seat, half the remaining 1N HCl is added to the water seat and melt mixture. 28.10 g of a 47% aqueous MTTMAC solution is added to the stirring mixture. This mixture is stirred an additional 5 minutes using a low-shear propeller blade mixer. The remaining 1N HCl is added to the mixture after about 4 minutes of stirring, thus adjusting the mixture pH to about 2.8. The mixture is cooled to 40° C. and 6.40 g of PDMS and 0.20 g of Silicone DC 1520, marketed by Dow Corning Corporation, located in Midland Mich. are added to the mixture with high-shear mixing (using a Tekmar mixer at 5,000 rpm). The softener actives of the resulting mixture have a typical average particle size of about 0.2–0.3 micron and are dispersed in an aqueous composition. The aqueous composition has a viscosity of about 30 centipoise (@25° C. ).

EXAMPLE III

A storage-stable, liquid fabric-softening composition of the present invention is made as follows:

| Ingredient | Percent (wt.) |
|---|---|
| (I) 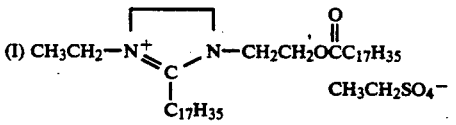 | 1.09% |
| (II) 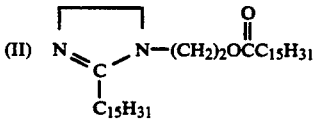 | 4.97% |
| Monotallow trimethyl ammonium chloride (MTTMAC) | 0.61% |
| Dye | 20 ppm |
| Polydimethylsiloxane (PDMS) | 0.32% |

-continued

| Ingredient | Percent (wt.) |
|---|---|
| Silicone DC 1520 | 0.01% |
| Perfume | 0.42% |
| HCl | 0.30% |
| Kathon ® CG/ICP | 0.03% |
| Water | Balance |

5.45 g of quaternary softener compound (I) and 24.85 g of imidazoline ester compound (II) are heated together at 65° C. to form a fluidized homogeneous "melt". The melt is then poured, with stirring, into 460.00 g of hot (70° C.) water containing 20 ppm of dye and 0.17 g of Kathon ® CG/ICP, marketed by the Rohm & Haas Company, located in Philadelphia, Pa. The pH of the water seat is adjusted to 2.8 prior to the addition of the melt using 1.0N HCl. Midway through the addition of the melt to the water seat, half the remaining 1N HCl is added to the water seat and melt mixture. 6.48 g of a 47% aqueous MTTMAC solution is added to the stirring mixture. This mixture is stirred an additional 5 minutes using a low-shear propeller blade mixer. The remaining 1N HCl is added to the mixture after about 4 minutes of stirring, thus adjusting the mixture pH to about 2.8. The mixture is cooled to 40° C. and 6.40 g of PDMS and 0.20 g of Silicone DC 1520, marketed by Dow Corning Corporation, are added to the mixture with high-shear mixing (using a Tekmar mixer at 5,000 rpm). The high-shear mixing is maintained for 2 minutes. The softener actives of the resulting mixture have a typical average particle size of about 0.2–0.3 micron and are dispersed in an aqueous composition. The aqueous composition has a viscosity of about 30 centipoise (@25° C.)

EXAMPLE IV

A storage-stable, liquid fabric-softening composition of the present invention is made as follows:

| Ingredient | Percent (wt.) |
|---|---|
| 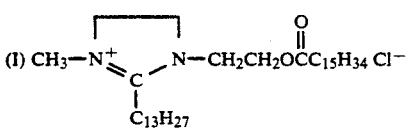 | 4.50% |
| 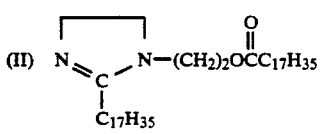 | 3.00% |
| Monotallow trimethyl ammonium chloride (MTTMAC) | 0.66% |
| Dye | 20 ppm |
| Perfume | 0.42% |
| HCl | 0.24% |
| Water | Balance |

45.00 g of quaternary softener compound (I) and 30.00 g of imidazoline ester compound (II) are heated together at 70° C. to form a fluidized homogeneous "melt". The melt is then poured, with stirring, into 925.00 g of hot (70° C. ) water containing 20 ppm of dye. The pH of the water seat is adjusted to 2.8 prior to the addition of the melt with 1.0N HCl. Midway through the addition of the melt to the water seat, half the remaining 1N HCl is added to the water seat and melt mixture. 14.00 g of a 47% aqueous MTTMAC solution is added to the stirring mixture. This mixture is stirred an additional 5 minutes using a low-shear propeller blade mixer. The remaining 1N HCl is added to the mixture after about 4 minutes of stirring, thus adjusting the mixture pH to about 2.8. The mixture is cooled to 40° C. and 4.20 g of perfume is added to the mixture with high-shear mixing (using a Tekmar mixer at 5,000 rpm). The high-shear mixing is maintained for 2 minutes. The softener actives of the resulting mixture have a typical average particle size of about 0.2–0.3 micron and are dispersed in an aqueous composition. The aqueous composition has a viscosity of about 25 centipoise (@25° C.).

EXAMPLE V

The preparation of a fabric-softener sheet for use in a hot-air clothes dryer is as follows:

| | Percent (wt.) |
|---|---|
| Fabric Conditioning Composition Components | |
| 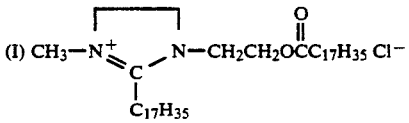 | 24% |
| 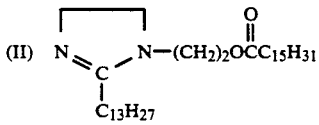 | 16% |
| Sorbitan monostearate | 52% |
| Bentolite L clay | 7.0% |
| Perfume | 1.0% |
| Dryer-added Sheet Substrate Composition | |
| Rayon fibers | 70% |
| Polyvinyl acetate | 30% |
| (10" × 14" (25.4 cm × 35.6 cm) sheets, 1.4 g) | |

The quaternary imidazoline softener compound (I), imidazoline ester compound (II), sorbitan monostearate, clay (Bentolite L, a montmorillonite clay obtained from Southern Chemical Products Company, located in Macon, Ga.) and perfume are mixed and heated to 80° C. to form a fluidized "melt". The substrate (made of the rayon fibers and polyacetate) is then coated with about 4 grams of the molten actives and dried overnight.

Following solidification of the fabric softening composition, the substrate is slit with a knife, said slits being in substantially parallel relationship and extending to within about 1 inch (2.54 cm) from at least one edge of said substrate. The width of an individual slit is approximately 0.2 inches (0.5 cm). These dryer added sheets are added to a clothes dryer together with damp fabrics to be treated (typically on sheet per 3.5 kg load of fabrics, dry weight basis). The heat and tumbling action of the revolving dryer drums evenly distributes the composition over all fabrics, and dries the fabrics. Fabric softening and static control are provided to the fabrics in this manner.

EXAMPLE VI

A storage-stable, liquid fabric-softening composition of the present invention is comprised as follows:

| Ingredient | Percent (wt.) |
|---|---|
| (I) 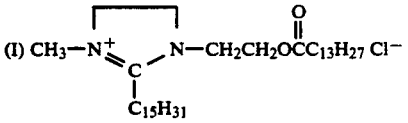 | 4.8% |
| (II) 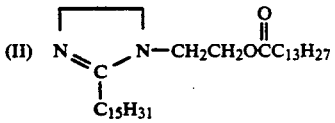 | 3.2% |
| HCl | 0.2% |
| Dye | 20 ppm |
| Water | Balance |

This composition is prepared as follows: place 80 kg of imidazoline ester compound (II) into a glass lined Pfaudler reactor, or other suitable corrosion resistant reactor. Heat the reactor contents to 80° C. and purge with $N_2$ gas to remove air and moisture. With the reactor at 0 kilograms per square centimeter gauge (kscg), introduce 4.4 kg of methyl chloride gas into the reactor at a pressure of 1.46 kscg. Maintain the temperature of the reactor contents in the range of from 80° C. to 85° C. while agitating. After 1 hour, purge the reactor with $N_2$ gas to remove any unreacted methyl chloride. The resulting product mixture will contain 60% by weight of quaternized di-substituted imidazoline ester compound (I) and 40% by weight of imidazoline ester compound (II).

A 0.8 kg portion of this product mixture is then heated to a temperature of about 80° C. to form a fluidized homogeneous "melt". The melt is then poured, with stirring, into 9.1 kg of hot (70° C.) water containing 20 ppm dye. The pH of the water seat is adjusted to about 2.8 prior to the addition of the melt using 1.0N HCl. Midway through the addition of the melt to the water seat, half of the remaining HCl is added to the water seat and melt mixture. The resulting mixture is stirred an additional 5 minutes using a low-shear propeller blade mixer. The remaining HCl is added to the mixture after 4 minutes of stirring, thus adjusting the mixture pH to about 2.8. The mixture is sheared for about 1 minute with high-shear mixing (using a Tekmar high-shear mixer at 7,000 rpm). The softener actives of the resulting mixture have a typical average particle size of about 0.2–0.3 micron and are dispersed in an aqueous dispersion. The aqueous dispersion has a viscosity of about 30 centipoise (@25° C.).

EXAMPLE VII

A storage-stable, liquid fabric-softening composition is comprised as follows:

| Ingredient | Percent (wt.) |
|---|---|
| (I) 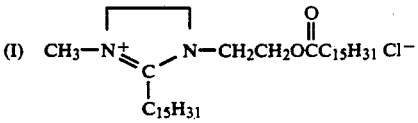 | 7.3% |
| (II) 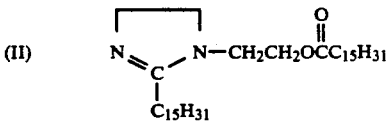 | 13.8% |
| Monotallow trimethyl ammonium chloride (MTTMAC) | 1.5% |
| Dye | 20 ppm |
| Polydimethylsiloxane (PDMS) | 1.1% |
| Silicone DC 1520 (marketed by Dow Corning Corp.) | 0.15% |
| HCl | 2.5% |
| Water | Balance |

This composition is prepared as follows: place 20.5 kg of imidazoline ester compound (II) into a glass lined Pfaudler reactor, or other suitable corrosion resistant reactor. Heat the reactor contents to 80° C. and purge with $N_2$ gas to remove air and moisture. With the reactor at 0 kilograms per square centimeter gauge (kscg), introduce 0.60 kg of methyl chloride gas into the reactor at a pressure of 1.46 kscg. Maintain the temperature of the reactor contents in the range of from 80° C. to 85° C. while agitating. After 1.5 hours, purge the reactor with $N_2$ gas to remove any unreacted methyl chloride. The resulting product mixture will contain 35% by weight of quaternized di-substituted imidazoline ester compound (I) and 65% by weight of imidazoline ester compound (II).

This product mixture is heated to a temperature of about 70° C. to form a fluidized homogeneous "melt". The melt is then poured into 74 kg of hot (70° C.) water containing 20 ppm dye. The pH of the water seat is adjusted to about 2.8 prior to the addition of the melt using 1.0N HCl. The water seat is stirred continuously during the addition of the "melt". Midway through the addition of the melt to the water seat, half the remaining 1.0N HCl is added to the water seat and melt mixture. Then 3.2 kg of a 47% aqueous MTTMAC solution is added to the stirring mixture. This mixture is stirred an additional 5 minutes using a low-shear propeller blade mixer. The remaining 1N HCl is added to the mixture after about 4 minutes of stirring, thus bringing the mixture pH to about 2.8. The mixture is cooled to about 40° C. and 1.1 kg of PDMS and 150 g of Silicone DC 1520, marketed by Dow Corning Corporation, are added to the mixture with high-shear mixing (using a Tekmar mixer at 5,000 rpm). The high-shear mixing is maintained for 2 minutes. The softener actives of the resulting mixture have a typical average particle size of about 0.2–0.3 micron and are dispersed in an aqueous dispersion. The aqueous dispersion has a viscosity of about 25 centipoise (@25° C.).

What is claimed is:

1. A liquid fabric softening and antistatic composition comprising:

(a) from about 1% to about 30% by weight of a quaternized di-substituted imidazoline ester softener compound of the formula

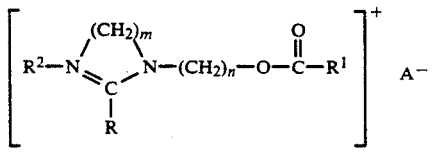

or

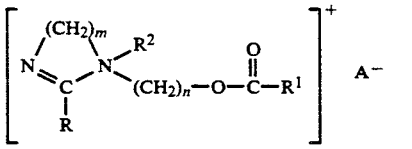

or mixtures thereof, wherein R and $R^1$ are, independently, $C_{11}$-$C_{21}$ hydrocarbyl groups, $R^2$ is a $C_1$-$C_4$ hydrocarbyl group, m and n are, independently from about 2 to about 4, and $A^-$ is an anion;

(b) from about 1% to about 30% by weight of a nonionic di-substituted imidazoline softener compound of the formula

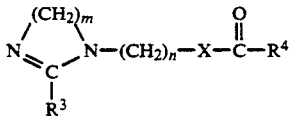

wherein $R^3$ and $R^4$ are, independently, $C_{11}$-$C_{21}$ hydrocarbyl groups, m and n are, independently from about 2 to about 4, and X is O, S, or $NR^5$, wherein $R^5$ is H or a $C_1$-$C_4$ alkyl group; and (c) a liquid carrier.

2. A composition according to claim 1 wherein R and $R^1$ are, independently, $C_{13}$-$C_{17}$ alkyl groups, $R^2$ is a $C_1$-$C_3$ alkyl group, and m and n are both 2.

3. A composition according to claim 2 wherein the liquid carrier is a mixture of (d) $C_1$-$C_4$ monohydric alcohol or mixtures thereof; and (e) water;

the concentration of monohydric alcohol ranging from about 0.1% to about 10% by weight of the softening compounds.

4. A composition according to claim 3 wherein the monohydric alcohol is isopropanol.

5. A composition according to claim 3 wherein the monohydric alcohol is ethanol.

6. A composition according to claim 3 wherein the softening compounds are present as particles dispersed in the liquid carrier.

7. A composition according to claim 6 wherein the particles have an average diameter of from about 0.1 to about 0.5 micron.

8. A composition according to claim 7 which is substantially free of unprotonated acyclic amines.

9. A composition according to claim 8 which is formulated at a pH of from about 1.5 to about 5.0.

10. A composition according to claim 9 in which is formulated at a pH ranging from about 1.8 to about 3.5.

11. A composition according to claim 8 which contains from about 3% to about 8% by weight of the quaternized di-substituted imidazoline ester compound (a) and from about 2% to about 8% by weight of di-substituted imidazoline compound (b).

12. A composition according to claim 11 wherein the nonionic di-substituted imidazoline compound (b) is

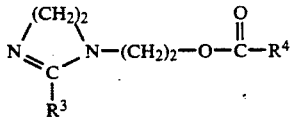

wherein $R^3$ and $R^4$ are, independently, $C_{13}$-$C_{17}$ alkyl groups.

13. A composition according to claim 12 wherein the quaternized di-substituted imidazoline ester compound (a) is

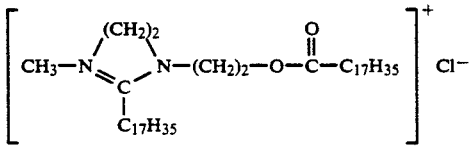

and wherein the imidazoline compound (b) is

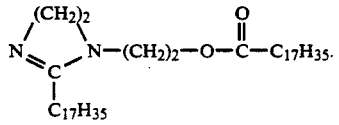

14. A composition according to claim 13 which additionally contains from about 0.1% to about 10% by weight of a nonionic extender.

15. A composition according to claim 14 which contain from about 0.3% to about 1.4% by weight of monotallow trimethyl ammonium chloride.

16. A composition according to claim 15 wherein the nonionic extender is selected from the group consisting of glycerol esters, fatty alcohols, ethoxylated linear alcohols, and mixtures thereof.

17. A composition according to claim 16 which additionally contains from about 10 to about 3,000 ppm of a salt selected from the group consisting of sodium citrate, calcium chloride, magnesium chloride, sodium chloride, potassium chloride, lithium chloride, and mixtures thereof.

18. A composition according to claim 17 wherein the salt is calcium chloride.

19. A fabric softener and antistatic composition in solid form comprising:

(a) from about 1% to about 30% by weight of a quaternized di-substituted imidazoline ester softener compound having the formula

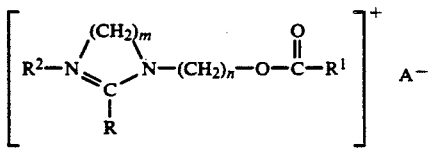

or

-continued

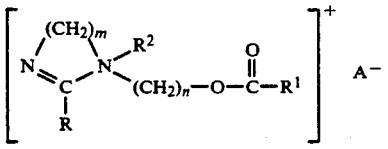

or mixtures thereof, wherein R and $R^1$ are, independently, $C_{11}$-$C_{21}$ hydrocarbyl groups, $R^2$ is a $C_1$-$C_4$ hydrocarbyl group, m and n are, independently from about 2 to about 4, and $A^-$ is an anion;

(b) from about 1% to about 30% by weight of a nonionic di-substituted imidazoline ester fabric softening compound of the formula

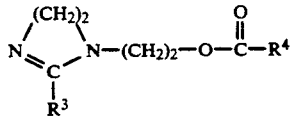

wherein $R^3$ and $R^4$ are, independently, $C_{13}$-$C_{17}$ alkyl groups; and (c) a solid carrier;

said softening compounds being releasably affixed to said solid carrier.

20. A composition according to claim 19 wherein in the quaternized di-substituted imidazoline compound (a) R and $R^1$ are, independently, $C_{13}$-$C_{17}$ alkyl groups, $R^2$ is a $C_1$-$C_3$ alkyl group, and m and n are both 2.

21. The composition according to claim 19 wherein the solid carrier is a sheet substrate.

22. A method of softening and providing an antistatic finish to fabrics by contacting said fabrics with an effective amount of the composition of claim 1.

* * * * *